US010881259B2

(12) United States Patent
Zhao et al.

(10) Patent No.: US 10,881,259 B2
(45) Date of Patent: Jan. 5, 2021

(54) LARGE TO MEDIUM-SIZE SWEEPING AND MOPPING VEHICLE AND MOPPING VEHICLE

(71) Applicant: ZHENGZHOU QINGCHENYU CLEANING EQUIPMENT CO., LTD., Zhengzhou (CN)

(72) Inventors: Songqi Zhao, Zhengzhou (CN); Zhanglei Wu, Zhengzhou (CN); Jianchao Zhao, Zhengzhou (CN)

(73) Assignee: ZHENGZHOU QINGCHENYU CLEANING EQUIPMENT CO., LTD., Zhengzhou (CN)

( * ) Notice: Subject to any disclaimer, the term of this patent is extended or adjusted under 35 U.S.C. 154(b) by 0 days.

(21) Appl. No.: 15/977,074

(22) Filed: May 11, 2018

(65) Prior Publication Data

US 2018/0296057 A1 Oct. 18, 2018

Related U.S. Application Data

(63) Continuation-in-part of application No. PCT/CN2016/080628, filed on Apr. 29, 2016.

(30) Foreign Application Priority Data

Nov. 11, 2015 (CN) ..... 2015 1 0766187

(51) Int. Cl.
*A47L 11/40* (2006.01)
*E01H 1/05* (2006.01)
(Continued)

(52) U.S. Cl.
CPC ..... *A47L 11/4038* (2013.01); *E01H 1/045* (2013.01); *E01H 1/053* (2013.01); *E01H 1/101* (2013.01); *E01H 1/04* (2013.01)

(58) Field of Classification Search
CPC ..... A47L 11/40; E01H 1/05; E01H 1/04
See application file for complete search history.

(56) References Cited

U.S. PATENT DOCUMENTS 3,186,015 A * 6/1965 Beyerstedt ..... E01H 1/047 15/84
3,186,016 A * 6/1965 Gehman ..... E01H 1/042 15/85

(Continued)

FOREIGN PATENT DOCUMENTS

CN 203701003 7/2014
CN 203716090 7/2014

(Continued)

OTHER PUBLICATIONS

International Search Report issued in Application No. PCT/CN2016/080628 dated May 18, 2017.

*Primary Examiner* — Michael D Jennings
(74) *Attorney, Agent, or Firm* — Hogans Lovells US LLP

(57) ABSTRACT

A large to medium-size sweeping and mopping vehicle and a mopping vehicle are provided. The large to medium-size sweeping and mopping vehicle includes a vehicle body, and a disc-type sweeping mechanism, a round-roller-type sweeping mechanism and a first mopping mechanism sequentially disposed along the vehicle body; the disc-type sweeping mechanism including a clean water tank and disc-type sweeping edge brushes driven by a motor and disposed obliquely with respect to ground, the clean water tank being disposed in front of the vehicle body driver zone, and a nozzle being disposed above each disc-type sweeping edge brush and in communication with the clean water tank; the round-roller-type sweeping mechanism including a refuse collector and a round-roller-type main sweeping brush driven by the motor to rotate horizontally; and the first mopping mechanism including a dragging roller, a guiding (Continued)

mopping roller, a guiding roller, a ring-shaped mop and a washing water tank.

20 Claims, 6 Drawing Sheets

(51) Int. Cl.
*E01H 1/10* (2006.01)
*E01H 1/04* (2006.01)

(56) References Cited

U.S. PATENT DOCUMENTS 4,754,521 A * 7/1988 Zoni ..... E01H 1/042 15/340.1
2004/0045111 A1* 3/2004 Engel ..... E01H 1/042 15/84

FOREIGN PATENT DOCUMENTS

CN 204608666 9/2015
CN 105297658 2/2016
CN 205205747 5/2016

* cited by examiner

LARGE TO MEDIUM-SIZE SWEEPING AND MOPPING VEHICLE AND MOPPING VEHICLE

CROSS-REFERENCE TO RELATED APPLICATIONS

The present application is a continuation-in-part application based on PCT Application No. PCT/CN2016/080628 filed on Apr. 29, 2016 and entitled "Large to Medium-size Sweeping and Mopping Vehicle," and claims priority to the Chinese patent application No. 2017109082180, filed with the Chinese Patent Office on Sep. 29, 2017 and entitled "Mopping Vehicle", and Chinese patent application No. 20151766187, filed with the Chinese Patent Office on Nov. 11, 2015 and entitled "Large-medium sweeping and mopping vehicle", the contents of which are incorporated herein by reference in their entirety.

TECHNICAL FIELD

The present disclosure relates to the technical field of environment cleaning equipment, and particularly to a large to medium-size sweeping and mopping vehicle and a mopping vehicle.

BACKGROUND ART

A mopping vehicle is equipment for cleaning away dust and dirt on road surfaces. The mopping vehicle can effectively clean relatively-large open areas such as squares, parking lots and so on. However, in practice, it is found that the prior mopping vehicles cannot effectively collect in place the ground solid refuses.

SUMMARY

The present disclosure provides a large to medium-size sweeping and mopping vehicle, in order to solve the problem that the prior mopping vehicles cannot effectively collect in place the ground solid refuses.

In order to solve the above technical problem, the embodiments of the present disclosure are realized as follows:

an embodiment of the present disclosure provides a large to medium-size sweeping and mopping vehicle, comprising a vehicle body, and a disc-type sweeping mechanism, a round-roller-type sweeping mechanism and a first mopping mechanism that are sequentially disposed along the vehicle body, wherein the disc-type sweeping mechanism comprises a clean water tank and disc-type sweeping edge brushes driven by a motor and disposed obliquely with respect to the ground, the clean water tank is disposed in front of a driver zone of the vehicle body, and each disc-type sweeping edge brush is provided with a nozzle, with the nozzle being located above the disc-type sweeping edge brush and in communication with the clean water tank;

the round-roller-type sweeping mechanism comprises a refuse collector and a round-roller-type main sweeping brush driven by the motor to rotate horizontally; and the first mopping mechanism comprises a dragging roller, a guiding mopping roller, a guiding roller, a ring-shaped mop and a washing water tank, the washing water tank is disposed behind the driver zone of the vehicle body, mop arms are hinged to the vehicle body, two ends of the guiding mopping roller and two ends of the guiding roller are fixedly connected with the mop arms, each mop arm is connected with the vehicle body through a lifting or upwardly-rotating mechanism, the ring-shaped mop is driven by the dragging roller and the guiding mopping roller to rotate, and the guiding roller is pressed on the ring-shaped mop.

Optionally, the first mopping mechanism further comprises a washing roller that is located in the washing water tank and is configured to wash the ring-shaped mop.

Optionally, the disc-type sweeping edge brush is disposed in front of the driver zone of the vehicle body, and the round-roller-type sweeping mechanism is disposed below the vehicle body.

Optionally, the large to medium-size sweeping and mopping vehicle further comprises a second mopping mechanism is in a structure same as the first mopping mechanism, the second mopping mechanism is disposed in front of the driver zone of the vehicle body, and the disc-type sweeping edge brushes and the round-roller-type sweeping mechanism are sequentially disposed below the vehicle body.

Optionally, each disc-type sweeping edge brush is suspended on the vehicle body through a quadrilateral coupler on which a first electric push rod configured to control the height of the disc-type sweeping edge brush is mounted.

Optionally, an upper portion of the refuse collector is connected with the vehicle body through four pull rods, and wheels are arranged below the refuse collector.

Optionally, the ring-shaped mop is made of long stapled chenille or coral flannelette, two sides of the ring-shaped mop are each provided with a grey fabric edge, and a circular cowhells (beef tendon) plastic strip is wrapped in the grey fabric edge.

Optionally, a plurality of sets of fixed-width wheels are fixed at both the inner side and the outer side of the washing water tank, and the fixed-width wheels are configured to get the circular cowhells plastic strip stuck.

Optionally, the guiding mopping roller has a silica gel layer or a round roller hairbrush as an outer layer thereof, and the guiding mopping roller has a metal tube or a metal rod as an inner layer thereof.

Optionally, a solar-photovoltaic-cell power generation plate and a metal profile are arranged at the top of the vehicle body, the solar-photovoltaic-cell power generation plate is fixedly connected with the metal profile, one end of the metal profile is hinged to the top of the vehicle body, and the other end of the metal profile is connected with the top of the vehicle body through a second electric push rod.

Optionally, the large to medium-size sweeping and mopping vehicle further comprises a washing driving device, wherein the mop arms are hinged to the washing water tank, the washing water tank is pivotally connected with the vehicle body, the washing driving device is configured to control the washing water tank to move so that the washing water tank can swing relative to the vehicle body with the vertical axis as a center, and when the washing water tank swings, the mop arms are driven to swing.

Optionally, the large to medium-size sweeping and mopping vehicle further comprises at least one flushing nozzle configured to flush the ground, the at least one flushing nozzle is connected with the vehicle body, and an included angle between the spraying direction of the at least one flushing nozzle and the ground is 20°-70°, the clean water tank and the washing water tank communicate with the at least one flushing nozzle; and when the at least one flushing nozzle sprays water, the water can be reflected by the ground to splash onto the ring-shaped mop.

Optionally, the washing water tank is provided therein with a filtering area and a washing area that is configured to allow the ring-shaped mop to enter and to be washed;

multiple layers of filter screens configured to separate the washing area from the filtering area are arranged between the washing area and the filtering area, the multiple layers of filter screens are arranged at intervals, and the diameters of filter holes of the filter screens are gradually reduced in the direction away from the ring-shaped mop; and the filtering area is configured to supply water to the at least one flushing nozzle.

Optionally, the filter screens are obliquely arranged in the washing water tank, and a filtering nozzle configured to flush the filter screens is provided above the filter screens; and the filter screens are capable of being lifted upwards relative to the washing water tank, so as to separate the bottom of the filter screen from the bottom wall of the washing water tank.

Optionally, the washing water tank is provided therein with a filtering area and a washing area that is configured to allow the ring-shaped mop to enter and to be washed;

a partition plate configured to separate the washing area from the filtering area is arranged between the washing area and the filtering area, a filter is arranged on the partition plate, and the filter is configured to filter water in the washing area and enable the filtered water to enter the filtering area; and the filtering area is configured to supply water to the at least one flushing nozzle.

Optionally, a water intake is arranged in the filtering area, and a fine net is arranged at the water intake, the water intake is in communication with each flushing nozzle through a pipeline, the pipeline between the water intake and the flushing nozzle is provided with a water pump, a first control valve configured to control connection/disconnection of the pipeline is arranged between the water pump and the water intake, a branch pipeline is arranged on the pipeline between the first control valve and the water pump, the branch pipeline is in communication with the clean water tank, and the branch pipeline is provided with a second control valve configured to control connection/disconnection of the branch pipeline.

Optionally, the washing driving device comprises a swing motor and a swing member, wherein the swing member is in a strip shape and is bendable and deformable, two free ends of the swing member are connected to different parts of the washing water tank respectively, and a power output end of the swing motor is configured to expand and stretch the swing member and drive the swing member to reciprocate, so as to drive the washing water tank to swing.

Optionally, the large to medium-size sweeping and mopping vehicle further comprises an adjusting assembly configured to adjust the position of the washing water tank; and the adjusting assembly comprises an elastic member through which the free ends of the swing member are connected with the washing water tank.

Optionally, the large to medium-size sweeping and mopping vehicle further comprises a rotating assembly configured to rotationally support the swinging of the washing water tank;

the rotating assembly comprises a ring-shaped rail and a plurality of idler wheels capable of freely moving in the ring-shaped rail; and the ring-shaped rail is mounted at the bottom of the washing water tank, and the idler wheels are mounted on the vehicle body; alternatively, the ring-shaped rail is mounted on the vehicle body, and the idler wheels are mounted at the bottom of the washing water tank.

The present disclosure provides a mopping vehicle in order to solve the technical problem that the prior mopping vehicle has a large turning radius, is poor in the operation flexibility, and is incapable of cleaning the corner areas and cleaning away the dust hidden in recesses.

In order to solve the above technical problems, embodiments of the present disclosure are implemented as follows:

an embodiment of the present disclosure provides a mopping vehicle, comprising a vehicle body, a seat, a manipulation mechanism, a control module, a clean water tank, a washing water channel, an operation mechanism, a sweeping mechanism and a mopping mechanism, the washing water channel being arranged behind the vehicle body, and the washing water channel being pivotally connected with the vehicle body. The mopping vehicle further comprises a washing driving device that is configured to control the washing water channel to move, the washing water channel being capable of swinging relative to the vehicle body with the vertical axis as the center, the mopping mechanism being mounted on the washing water channel, and when the washing water channel swings, the mopping mechanism being driven to swing.

Compared with the prior art, the advantageous effects of the embodiments of the present disclosure include, for example, according to the present disclosure, a sweeping system being combined with a mopping system, wherein the sweeping system is capable of efficiently collecting solid refuses while the mopping system is capable of efficiently removing dust from the ground, and refuses and dust can be cleaned away from roadside by using edge brushes, with assistance of a water spraying system.

BRIEF DESCRIPTION OF DRAWINGS

In order to more clearly illustrate the technical solutions of the embodiments of the present disclosure or in the prior art, brief description is made below on the drawings required to be used in the description of the embodiments or the prior art. Obviously, the following drawings only illustrate some of the embodiments of the present disclosure, and for a person of ordinary skills in the art, other drawings may be obtained from these drawings without inventive effort.

REFERENCE SIGNS

Figure 1:
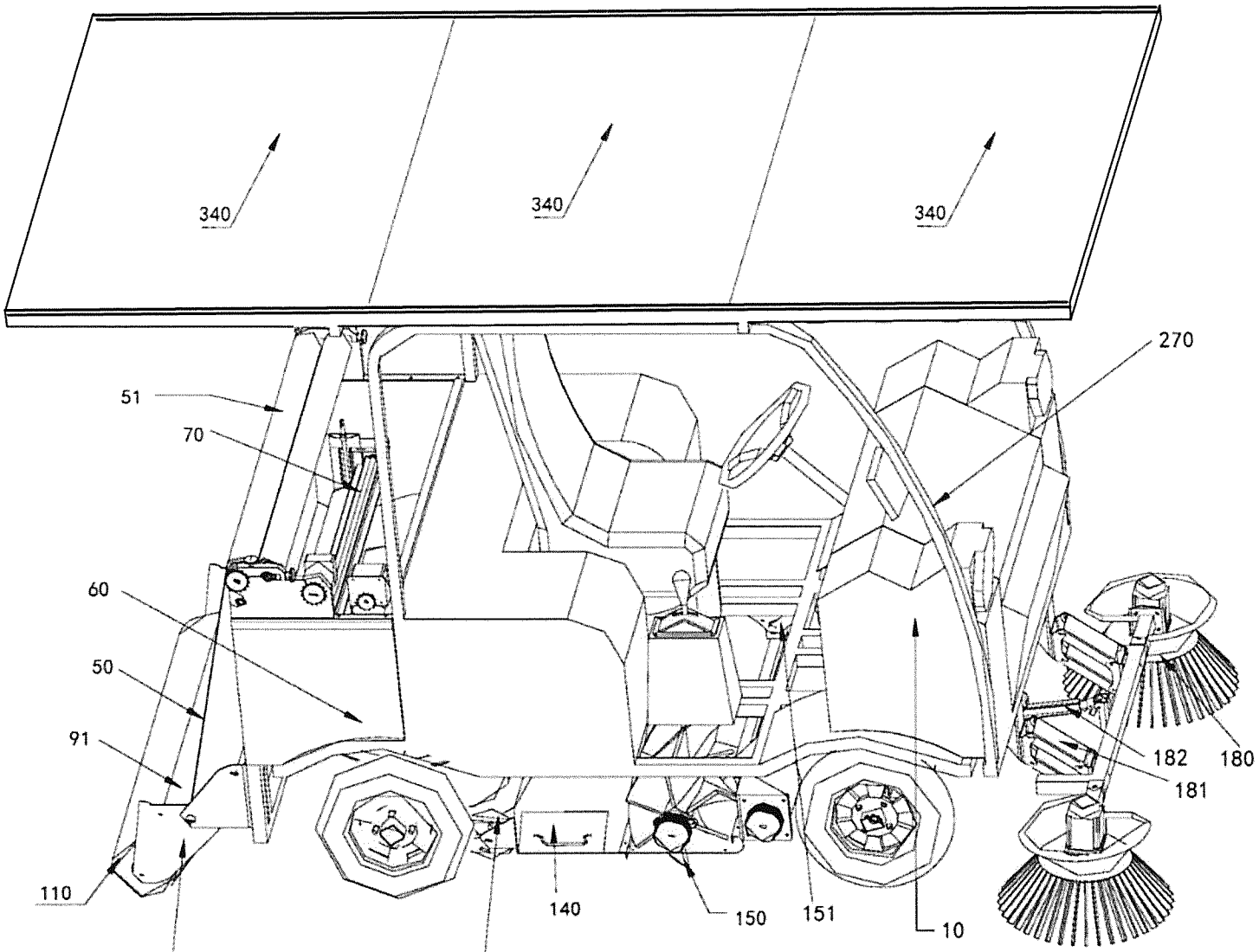
FIG. 1 is a schematic structural diagram of a large to medium-size sweeping and mopping vehicle according to embodiments of the present disclosure.

10—clean water tank; 20—seat; 30—washing motor; 40—dragging motor; 50—dragging roller assembly;

51—dragging roller; 60—washing water tank; 70—washing roller; 80—washing guiding roller; 90—guiding roller assembly; 91—guiding roller; 100—ring—shaped mop; 110—guiding mopping roller; 120—third electric push rod; 130—rear vehicle wheel; 140—refuse collector; 150—round—roller—type main sweeping brush; 151—pull rod; 152—wheel; 160—main brush motor; 170—front vehicle wheel; 180—disc—type sweeping edge brush; 181—quadrilateral coupler; 182—first electric push rod; 190—water pump; 200—steering wheel; 210—flushing nozzle; 220—swing motor; 230—ring—shaped rail; 240—roller; 250—universal control lever; 260—control module; 270—vehicle body; 280—swing member; 290—spring; 300—filtering nozzle; 310—mop arm; 320—lifting or upwardly—rotating mechanism; 330—fixed—width wheel; 340—solar—photovoltaic—cell power generation plate.

DETAILED DESCRIPTION OF EMBODIMENTS

In order to make the objects, technical solutions and advantages of the embodiments of the present disclosure clearer, the technical solutions of the embodiments of the present disclosure will be described clearly and completely below with reference to the drawings of the embodiments of the present disclosure. Apparently, the embodiments described are some of the embodiments of the present disclosure, rather than all of the embodiments. The components of the embodiments of the present disclosure described and illustrated in the drawings herein can generally be arranged and designed in a variety of different configurations.

Thus, the following detailed description of the embodiments of the present disclosure provided in the drawings is not intended to limit the scope of the claimed disclosure, but is merely representative of the selected embodiments of the present disclosure. All the other embodiments that are obtained by a person of ordinary skills in the art without inventive effort on the basis of the embodiments of the present disclosure shall be covered by the protection scope of the present disclosure.

It should be noted that similar reference signs and letters denote similar items in the drawings, and therefore, once a certain item is defined in one figure, it does not need to be further defined and explained in the subsequent figures.

In the description of the present disclosure, it is to be understood that the orientation or position relation denoted by the terms such as "center", "upper", "lower", "left", "right", "vertical", "horizontal", "inner" and "outer" is based on the orientation or position relation indicated by the figures, or refers to the orientation or position where the product of the present disclosure is normally placed when in use, which only serves to facilitate describing the present disclosure and simplify the description, rather than indicating or suggesting that the related device or element must have a particular orientation or be constructed and operated in a particular orientation, and therefore cannot be construed as a limitation on the present disclosure.

In addition, the terms such as "first", "second" and "third" are only used for differentiated description and cannot be understood as an indication or implication of importance in relativity.

Furthermore, the terms such as "horizontal", "vertical" and "pendulous" do not necessarily require that the components must be absolutely horizontal or pendulous, rather, they can be slightly inclined. For example, the term "horizontal" merely refers to a horizontal direction relative to the direction indicated by the term "vertical", and does not necessarily require that the structure must be absolutely horizontal, rather, it can be slightly inclined.

In the description of the present disclosure, it should be further noted that unless otherwise explicitly specified and defined, the terms "arrange", "mount", "link" and "connect" shall be understood in a broad sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skills in the art could understand the specific meaning of the terms in the present disclosure according to specific situations.

Embodiment 1

Figure 2:
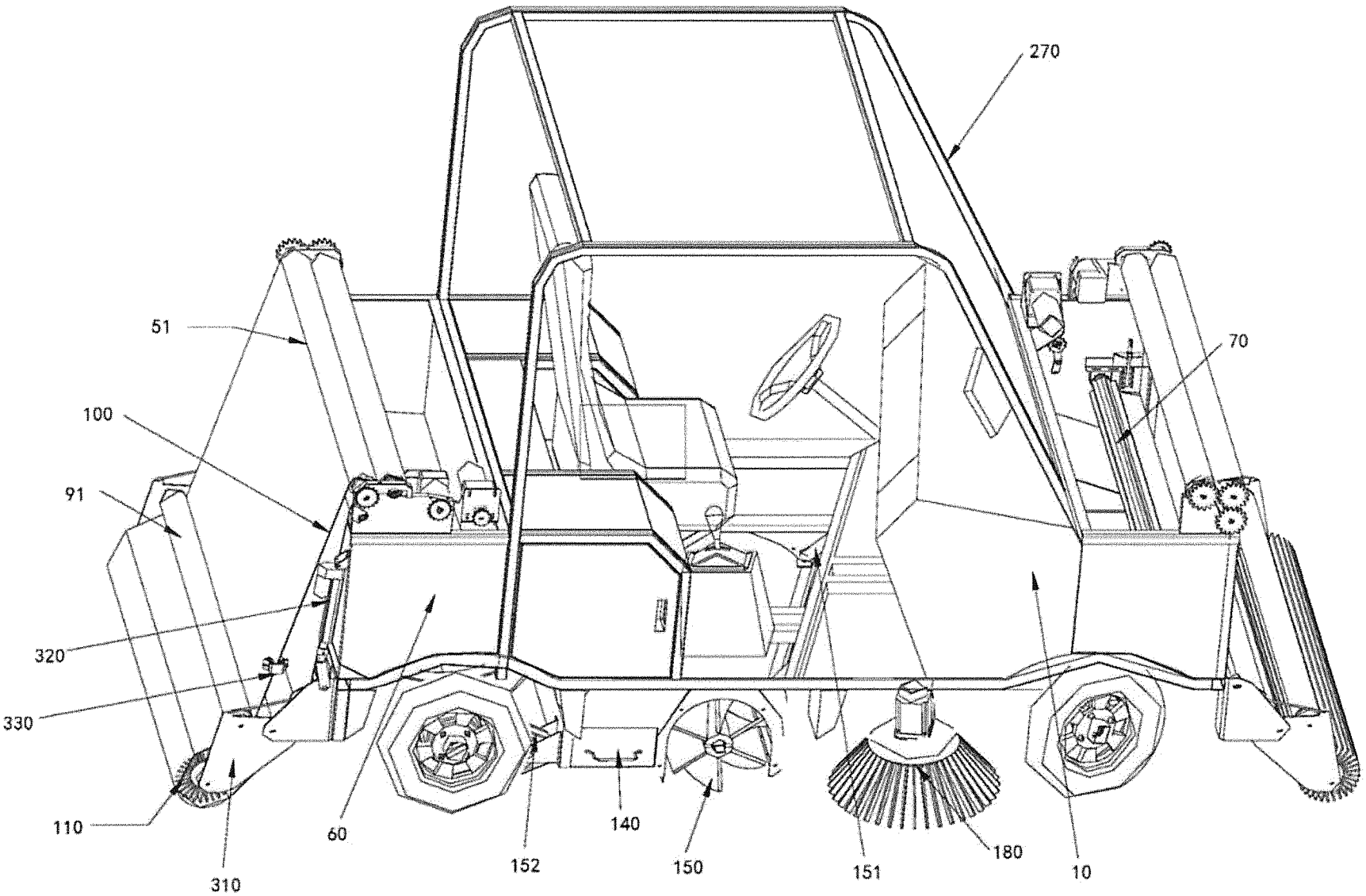
FIG. 2 is a schematic structural diagram of another large to medium-size sweeping and mopping vehicle according to embodiments of the present disclosure.

Referring to FIG. 1 and FIG. 2, the present embodiment provides a large to medium-size sweeping and mopping vehicle, comprising a vehicle body 270, and a disc-type sweeping mechanism, a round-roller-type sweeping mechanism and a first mopping mechanism that are sequentially disposed along the vehicle body 270. The disc-type sweeping mechanism is disposed in front of a driver zone of the vehicle body 270. The round-roller-type sweeping mechanism is disposed below the vehicle body 270. The first mopping mechanism is disposed behind the driver zone of the vehicle body 270.

The disc-type sweeping mechanism comprises a clean water tank 10, and disc-type sweeping edge brushes 180 driven by a motor and disposed obliquely with respect to the ground. The clean water tank 10 is disposed in front of the driver zone of the vehicle body 270. Each disc-type sweeping edge brush 180 is provided thereon with a nozzle, with the nozzle in communication with the clean water tank 10.

The disc-type sweeping edge brush 180 is suspended on the vehicle body 270 through a quadrilateral coupler 181. A first electric push rod 182 configured to control the height of the disc-type sweeping edge brush 180 is mounted on the quadrilateral coupler 181.

The disc-type sweeping edge brush 180 is driven by the first electric push rod 182 to descend at any time to sweep the ground or ascend at any time to stop the sweeping operation. In order to prevent dust from flying in the sweeping process, it is necessary to suck, using a water pump, water from the clean water tank 10 or filtered water, and spray, using the nozzle, the water onto the ground from above and in front of the disc-type sweeping edge brush 180. The round-roller-type sweeping mechanism comprises a refuse collector 140 and a round-roller-type main sweeping brush 150 driven by the motor to rotate horizontally. The upper portion of the refuse collector 140 is connected with the vehicle body 270 through four pull rods 151, wherein each pull rod 151 has two ends in shaft connection with the vehicle body. Wheels 152 are arranged below the refuse collector 140.

The round-roller-type sweeping mechanism is mainly used for collecting solid refuses with relatively large size, including leaves, paper scraps, plastic bags and other sundries, and is also used for collecting dust which has relatively small particle sizes and is large in number. The four pull rods 151 above the refuse collector 140 and the four wheels 152 below the refuse collector 140 as well as the adjusting screws connecting them not only can satisfy the requirement of automatically adjusting the height of the refuse collector when the ground is uneven, but also can satisfy the requirement of manually adjusting the height of the main brush when the main brush wears. The disc-type sweeping edge brush 180 is mounted at a position projecting from the vehicle body 270 by about 10-20 cm. When sweeping, the disc-type sweeping edge brushes 180 collect refuses at two sides of the mopping vehicle into the sweeping area of the round-roller-type main sweeping brush 150, and the round-roller-type main sweeping brush 150 sweeps the refuses collected into the sweeping area thereof, into the refuse collector 140.

The first mopping mechanism comprises a dragging roller 51, a guiding mopping roller 110, a guiding roller 91, a ring-shaped mop 100 and a washing water tank 60, wherein the washing water tank 60 is disposed behind the driver zone of the vehicle body 270, mop arms 310 are hinged onto the vehicle body 270, two ends of the guiding mopping roller 110 and two ends of the guiding roller 91 are fixedly connected with the mop arms 310 respectively, each mop arm 310 is connected with the vehicle body 270 through a lifting or upwardly-rotating mechanism 320, the ring-shaped mop 100 is driven by the dragging roller 51 and the guiding mopping roller 110 to rotate, and the guiding roller 91 is pressed above the ring-shaped mop 100.

Moreover, the first mopping mechanism further comprises a washing roller 70. The washing roller 70 is formed by welding four corner bars of a height of several centimeters to the outside of a stainless steel tube. The washing roller 70 is located in the washing water tank 60 and is configured to wash the ring-shaped mop 100.

Of course, for the washing roller 70, a metal tube or a metal rod can be used, the number of the corner bars can be four or greater, or four or more corner bars form a metal tube.

The ring-shaped mop 100 is made of long stapled chenille or coral flannelette, or other grey fabrics, two sides of the ring-shaped mop 100 are each provided with a grey fabric edge, and a circular cowhells plastic strip is wrapped in the grey fabric edge.

The cowhells plastic strip is a circular plastic strip that is commercially available and has relatively high toughness.

Generally, a flexible layer will be additionally provided at the outer layer of the dragging roller 51, and the guiding mopping roller 110 will be additionally provided with a thicker flexible layer; and in practice, a hairbrush with the thickness of about 5 cm can be used.

A plurality of sets of fixed-width wheels 330 are fixed at both the inner side and the outer side of the washing water tank 60, and the fixed-width wheels 330 get the circular cowhells plastic strip stuck. The fixed-width wheels 330 may be made of engineering plastics, or may also be replaced by stainless steel bearings.

The guiding mopping roller 110 has a silica gel layer or a relatively-hard round roller hair brush as the outer layer thereof, and the guiding mopping roller 110 has a metal tube or a metal rod as the inner layer thereof.

Moreover, a rubber-coated metal tube or a rubber-coated metal rod may be used as the dragging roller 51.

For the guiding roller 91, a metal tube or a metal rod can be used, and the two ends thereof can be fixed on the mop arms 310 using a metal rod shaft.

It is necessary for cleaning the ground that the ring-shaped mop 100 is in pressurized contact with the ground, wherein if the pressure is too large, the ring-shaped mop 100 will wear too fast, and if the pressure is small, the cleaning effect will be poor. In addition, most of the ground is not even enough, so the guiding mopping roller 110 which presses the ring-shaped mop 100 onto the ground should be made of a suitable flexible material.

In the non-mopping time, a mechanism is needed to pull up the ring-shaped mop 100 which comes into contact with the ground at work, such that the ring-shaped mop is separated from the ground. The lifting or upwardly-rotating mechanism 320 can be an electric push rod, an air cylinder, an oil cylinder or a screw rod driven by a motor. It is feasible to lift or upwardly rotate the mop arm 310 with the screw rod driven by an electric push rod, an air cylinder, an oil cylinder or a motor, or fasten a rope to two ends of the mop arm 310, and guide the rope by a fixed pulley or directly connect the rope with a wheel axle which is driven by the motor to lift up or put down the mop arm 310, or connect the rope with a lever and pull the lever with a hand or push the lever with a foot to enable the mop arm 310 to ascend or descend.

In the above, a solar-photovoltaic-cell power generation plate 340 and a metal profile are disposed at the top of the vehicle body 270, the solar-photovoltaic-cell power generation plate 340 is fixedly connected with the metal profile, one side edge of a lower surface of the metal profile is hinged to the top of the vehicle (vehicle roof), and another side edge of the lower surface of the metal profile is connected with the roof through the second electric push rod. By lifting and lowering the second electric push rod, the solar-photovoltaic-cell power generation plate 340 can form an inclined surface with respect to the top of the vehicle.

This kind of large to medium-size sweeping and mopping vehicle mostly works in the early morning or at night, and is powered by a storage battery. If the solar-photovoltaic-cell power generation plate 340 is installed on the top of the vehicle to generate electricity by making use of the daytime sunlight and store the electricity in the storage battery, a lot of energy will be saved, and especially when the angle of the battery panel is adjusted using steering or adjustment, more cheap electric energy can be obtained with lower cost, and contributions can also be made to environmental protection by saving electric energy. Moreover, the solar-photovoltaic-cell power generation plate 340 can be fixed on the top of the vehicle in a manner of fixed plane.

If the solar-photovoltaic-cell power generation plate 340 is installed on the top of the vehicle, two groups or more of triangular supports can be arranged on the top of the vehicle in the longitudinal direction, the middle longitudinal beam of the metal support fixing the solar-photovoltaic-cell power generation plate 340 is connected with the triangular supports through pin shafts, and a side longitudinal beam of the metal support fixing the power generation plate is connected with the vehicle body 270 through the second electric push rod, and is driven by the second electric push rod to rotate about the middle longitudinal beam of the triangular support by a certain angle. The top of the vehicle can also be embodied as a plane support, and the solar-photovoltaic-cell power generation plate 340 is fixed onto the top of the vehicle in the manner of fixed plane. In the present embodiment, the solar-photovoltaic-cell power generation plate 340 is formed by combining three standard assemblies of 1.46×1 m.

In the present embodiment, the vehicle body 270, the washing water tank 60 and all the other homemade structural components are all formed by welding stainless steel profiles. Although the materials are high in price, no surface treatment is needed, which reduces the impact of the manufacturing process on the environment, and also can avoid the rusting risk in the future.

Other components of the vehicle body 270 such as the wheels, the vehicle axle, the steering wheel, the forward/reverse gear, the battery, the electric appliance box and various electric appliance elements, the walking motor, the seat, the vehicle lamps and the rearview mirrors are all standard components for electric cars.

The large to medium-size sweeping and mopping vehicle in the present embodiment is a medium-sized mopping vehicle for outdoor ground cleaning for factories, schools and large institutions, and can be used as a vehicle for cleaning streets, roads and even highways when the washing water tank 60 and the clean water tank 10 are appropriately enlarged and a refuse storage area is arranged beside the driver zone.

The working principles of the large to medium-size sweeping and mopping vehicle of the present embodiment are as follows:

The disc-type sweeping edge brushes 180 are installed on two sides in front of the front wheels respectively, which serves to sweep the roadside refuses and dust to the area that the round-roller-type main sweeping brush 150 and the ring-shaped mop 100 can reach, the round-roller-type main sweeping brush 150 feeds the refuses with relatively large sizes into the refuse collector 140, and the ring-shaped mop 100 brings, by means of adhesion, the residual dust into the washing water tank 60.

By angle adjustment through the second electric push rod, in the non-working time where sun exposure exits, the solar-photovoltaic-cell power generation plate 340 installed on the top of the vehicle is capable of adjusting the vehicle to a better angle and orientation, such that the storage battery can obtain more electric energy.

Embodiment 2

As shown in FIG. 2, the present embodiment provides a large to medium-size sweeping and mopping vehicle, comprising a vehicle body 270, and a disc-type sweeping mechanism, a round-roller-type sweeping mechanism, a first mopping mechanism and a second mopping mechanism that are sequentially disposed along the vehicle body 270, wherein the first mopping mechanism and the second mopping mechanism have the same structure, the disc-type sweeping mechanism and the round-roller-type sweeping mechanism are disposed below the vehicle body 270, the first mopping mechanism is disposed behind the driver zone of the vehicle body 270, and the second mopping mechanism is disposed in front of the driver zone of the vehicle body 270.

The present embodiment has the same structure as those in Embodiment 1, except that no solar-photovoltaic-cell power generation plate 340 is arranged at the top of the vehicle body 270, and therefore will not be further described herein.

The large to medium-size sweeping and mopping vehicle in Embodiment 2, mainly used in places with relatively high cleaning requirements has a set of mopping mechanism is provided at each of the front and the rear thereof. During use, the set of mopping mechanism in front of the vehicle body implement first mopping to clean away some floating dust on the surface and also wet the adhered dirt, the edge brushes and the main brush sweep into the refuse collector 140 the refuses at the roadsides and the corners and the refuses that cannot be adhered to the mop, and then second mopping is performed the set of mopping mechanism behind the vehicle body, greatly improving the cleaning degree.

Embodiment 3

Referring to FIGS. 3-6, the present embodiment provides a large to medium-size sweeping and mopping vehicle, comprising a vehicle body 270, a seat 20, a manipulation mechanism, a control module 260, a clean water tank 10, a washing water tank 60, an operation mechanism, a sweeping mechanism, a mopping mechanism and a washing driving device, wherein the washing water tank 60 is disposed behind the vehicle body 270, and the washing water tank 60 is pivotally connected with the vehicle body 270.

Mop arms 310 are hinged to the washing water tank 60, the washing driving device is configured to control the washing water tank 60 to move such that the washing water tank 60 is capable of swinging relative to the vehicle body 270 with the vertical axis as a center, and when the washing water tank 60 swings, the mop arms 310 are driven to swing, so as to carry out the mopping operation.

Moreover, the present embodiment further provides a mopping vehicle, comprising a vehicle body 270, a seat 20, a manipulation mechanism, a control module 260, a clean water tank 10, a washing water channel, an operation mechanism, a sweeping mechanism and a mopping mechanism. The washing water channel is arranged at a rear of the vehicle body 270. The washing water channel is pivotally connected with the vehicle body. The mopping vehicle further comprises a washing driving device that is configured to control the washing water channel to move, wherein the washing water channel is capable of swinging relative to the vehicle body 270 with the vertical axis as the center, the mopping mechanism is mounted on the washing water channel, and when the washing water channel swings, the mopping mechanism is driven to swing.

The washing water channel here is in a structure same as the washing water tank 60.

During the ground cleaning operation of the mopping vehicle, when the mopping vehicle encounter narrow areas or other areas, such as corners and roadsides, that conventional large mopping vehicles cannot clean well, cleaning of the corners and roadsides can be realized by moving the vehicle body 270 to the vicinity of such areas by the manipulation mechanism, and then making the washing driving device move to drive the washing water tank 60 to swing relative to the vehicle body 270, so that the washing water tank 60 is rotated within a certain range.

For the mopping vehicle, by means of the wagging-type mopping operation of the mopping mechanism, the usage mode and the cleaning range of the mopping vehicle are increased, further cleaning of corners and roadsides is realized, and the drawback that a conventional large mopping vehicle cannot clean the areas around corners is overcome, which greatly improves the working capacity of the mopping vehicle and has important significance for realizing large-scale cleaning of the places such as communities, schools, factories, shopping malls and hospitals.

In the present embodiment, the pivoting structure between the washing water tank 60 and the vehicle body 270 can be determined specifically according to the material of the washing water tank 60 and by taking account of the cost of the manufacturing process and the difficulty degree in implementation. For example, when the washing water tank 60 is in the form of a plastic structure made by the technology of rotational molding, it is feasible to arrange a rotation shaft on the vehicle frame of the vehicle body 270, and arrange the socket (recess) on the washing water tank 60; and when the washing water tank 60 is in the form of a metal structure made of metal materials such as stainless steel and the like, it is feasible to arrange the rotation shaft on the washing water tank 60, and arrange the socket on the frame.

Figure 4:
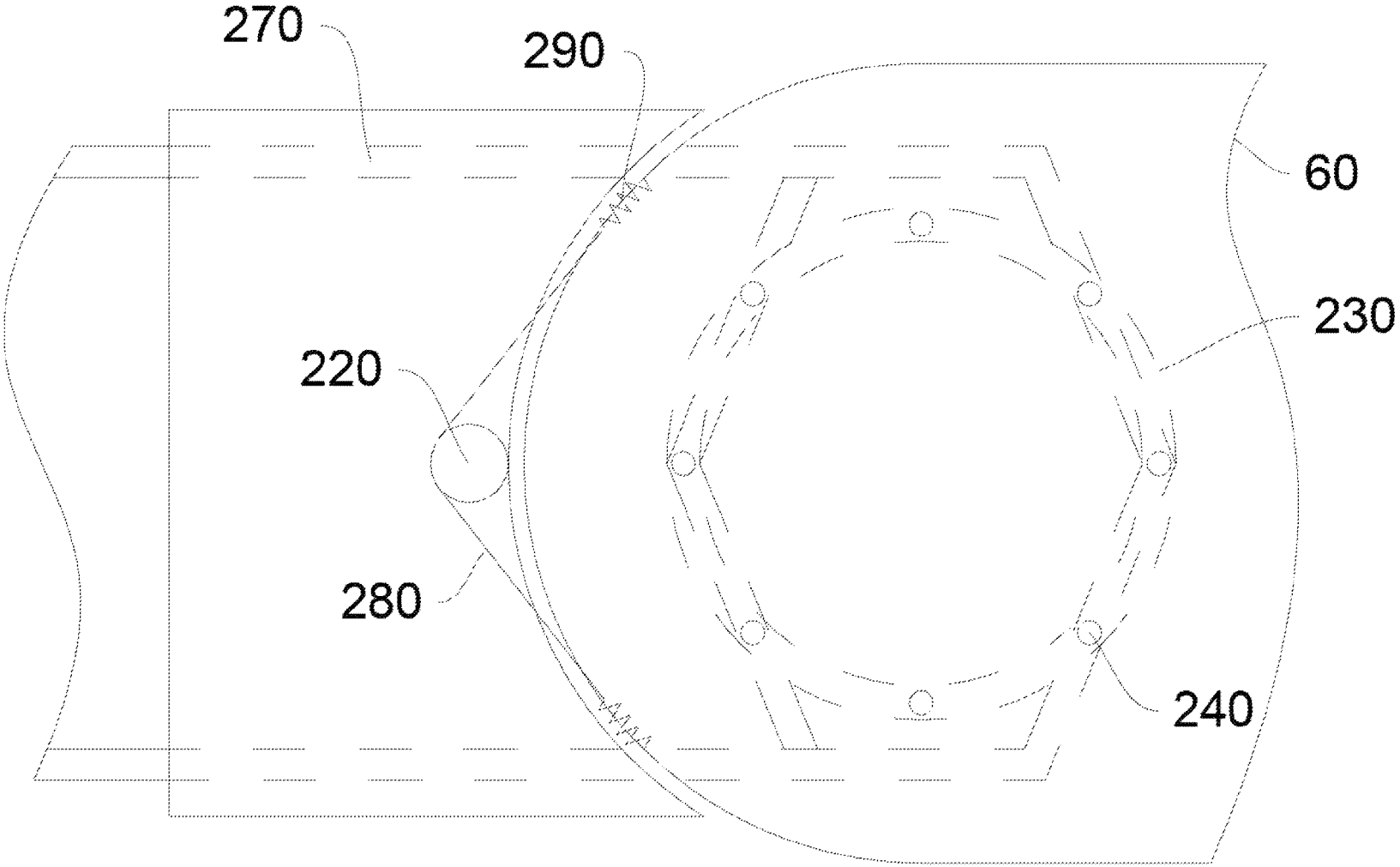
FIG. 4 is a schematic diagram showing a local structure of the large to medium-size sweeping and mopping vehicle in FIG. 3.

As shown in FIG. 4, in this embodiment, the washing driving device may comprise a swing motor 220 and a swing member 280. Specifically, the swing member 280 is in a strip shape and is bendable and deformable, two free ends of the swing member 280 are connected to different parts of the washing water tank 60, and the power output end of the swing motor 220 expands and stretches the swing member 280 and drives the swing member 280 to reciprocate, thereby driving the washing water tank 60 to swing.

In the present embodiment, the washing driving device can further comprise a driving wheel, wherein the driving wheel is fixedly connected with the power output end of the swing motor 220, and the swing member 280 is connected with the driving wheel to achieve synchronous movement. Referring to FIG. 4, the washing water tank 60 comprises a front wall close to a vehicle head, a rear wall away from the vehicle head and two side walls arranged between the front wall and the rear wall. The axis of the driving wheel is vertical, and the two free ends of the swing member 280 are fixedly connected with the two side walls of the washing water tank 60, respectively.

When it is required that the washing water tank 60 drives the mopping mechanism to performing wagging operation, the swing motor 220 operates to output the rotation power to the driving wheel. Taking the orientation shown in FIG. 4 as an example, when the driving wheel rotates clockwise, the swing member 280 at the upper portion will be stretched, and the swing member 280 at the lower portion will be shortened, and in such case, the washing water tank 60 will swing clockwise; and when the driving wheel rotates anti-clockwise, the swing member 280 at the upper portion will be shortened, the swing member 280 at the lower portion will be stretched, and the washing water tank 60 will swing anticlockwise.

In the present embodiment, the swing member 280 can also be embodied as a synchronous belt, and in such a case, a belt wheel whose teeth are matched with the teeth of the synchronous belt is used as the driving wheel, and the reliability of transmission is ensured through the meshing between the belt wheel and the synchronous belt.

It should be noted that in the present embodiment, the manner that the driving wheel provides power transmission to the washing water tank 60 can be realized by the structural form of a synchronous belt as described above, but not limited thereto, instead, other structural forms can be used, for example, a chain and correspondingly, a chain wheel used as the driving wheel, wherein the transmission reliability is ensured through the meshing transmission between the chain wheel and the chain.

Alternatively, in the present embodiment, the swing member 280 can also be embodied as a pulling rope. Specifically, friction force, enabling the pulling rope to synchronously move along with the driving wheel, exists between the pulling rope and the driving wheel, or the pulling rope is fixedly installed on the driving wheel. When the driving wheel rotates, the pulling rope is driven to move, pulling the washing water tank 60 to perform wagging operation.

Of course, the power transmission provided by the driving wheel to the washing water tank 60 can also be realized through a meshing structure of a gear and a gear ring. Specifically, the driving wheel is a pinion, and a big gear ring is arranged at the outer edge of the washing water tank 60. Thus, it is sufficient that the power of the swing motor 220 can be reliably transmitted to the washing water tank 60 by means of such transmission structure, so that the wagging operation of the washing water tank 60 can be realized.

In the present embodiment, the swing motor 220 can employ the structural form in which the shaft head is vertically downwardly mounted, and is fixedly connected with the vehicle frame through a mounting plate, moreover, a motor having the band-type brake function can be used as the swing motor 220.

Referring to FIG. 4, in the present embodiment, the mopping vehicle can further be provided with an adjusting assembly that is configured to adjust the position of the washing water tank 60. Specifically, the adjusting assembly comprises an elastic member through which the free end of the swing member 280 is fixedly connected with the side wall of the washing water tank 60. In the above, the elastic member can be a spring 290. During the mopping operation, the arrangement of the spring 290 enables the position of the washing water tank 60 to be adjusted according to the actual conditions of the corners and the road surfaces, so that the ring-shaped mop 100 is maintained in the working state of being closest to the corners, so as to ensure the smoothness of the mopping operation. Such arrangement has certain buffering effect, prevents, to a certain extent, impact damage to the swing motor 220 caused by rigid vibration, and further ensures the working reliability of the mopping vehicle.

In addition, in the present embodiment, protrusions can further be provided on the side walls of the washing water tank 60, and a corresponding distance sensor is provided on the vehicle frame, and meanwhile an alarm device in control connection with a limit switch is provided. When detecting that the ring-shaped mop 100 deviates from or gets close to the wall to a certain extent, a distance sensor outputs a detected signal to the alarm device, and the alarm device gives an alarm to prompt the operator.

In the above, the alarm device can take the form of an indicator lamp, a buzzer or a combination of the two, i.e., when the alarm device gives an alarm, the operator may be prompted by flickering of the indicator lamp, the operator may be prompted by the sound of the buzzer, or the operator may be prompted by both of them. Such arrangement enables timely feedback of the working state of the mopping mechanism to the operator, achieving high control precision.

Referring to FIG. 4, in the present embodiment, the structure of the washing water tank 60 can be the form that arc-shaped edge is connected with straight edges with smooth transition. Specifically, the side close to the vehicle head is an arc-shaped edge, the side at the rear of the vehicle is a straight edge, and when the washing water tank 60 is at an original position, the margin of the arc-shaped edge of the washing water tank 60 goes beyond the side walls of the vehicle body 270.

Figure 3:
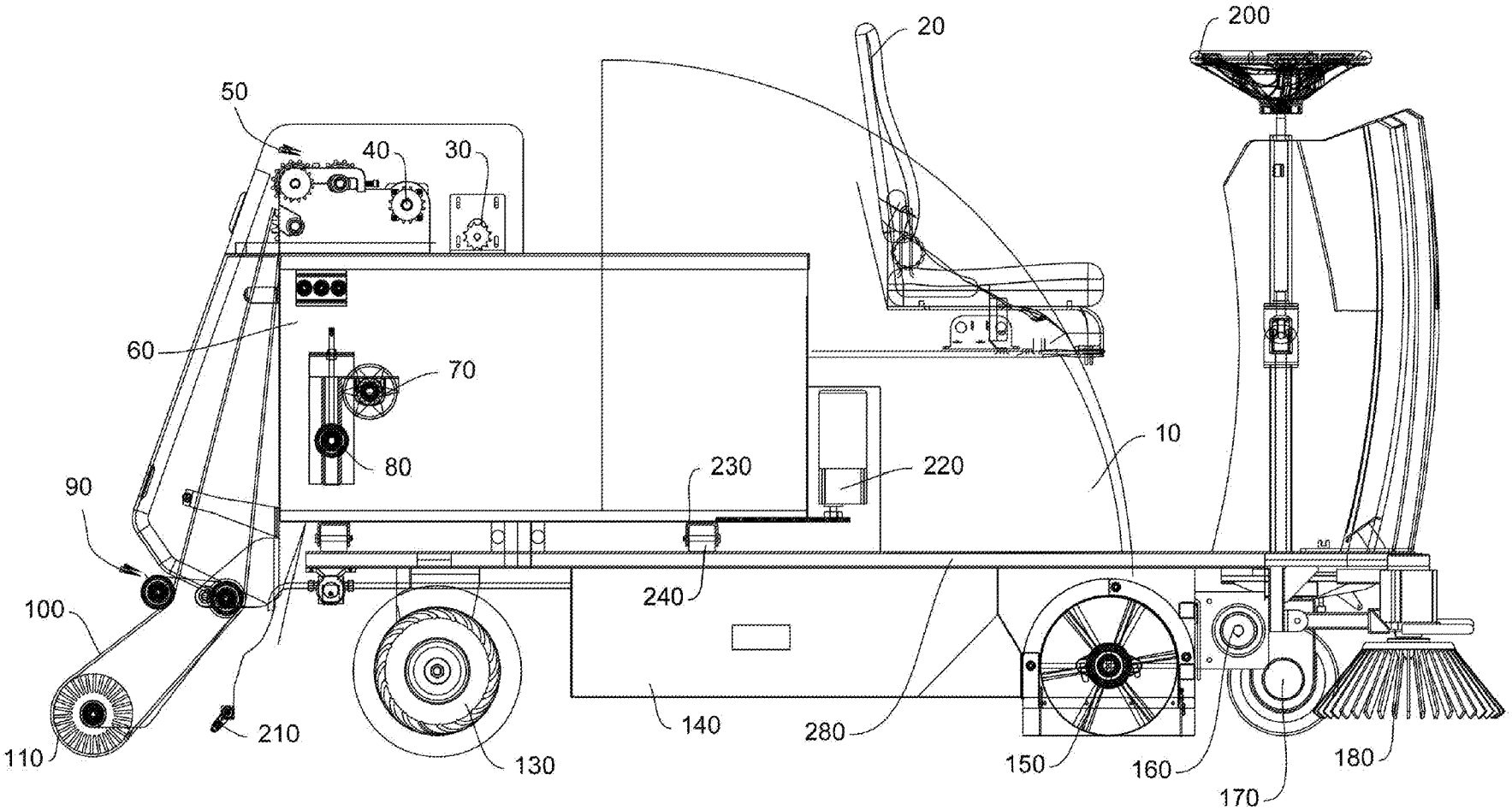
FIG. 3 is a schematic structural diagram of another large to medium-size sweeping and mopping vehicle according to embodiments of the present disclosure, from a first view angle.

Referring to FIG. 3 and FIG. 4, in this embodiment, the mopping vehicle can further comprise a rotating assembly configured to rotationally support the swinging of the washing water tank 60. In the above, the rotating assembly comprises a ring-shaped rail 230 and a plurality of idler wheels 240 capable of freely moving in the ring-shaped rail 230. Specifically, the structure may be the ring-shaped rail 230 being mounted at the bottom of the washing water tank 60 while the idler wheels 240 being mounted on the vehicle body 270, or the ring-shaped rail 230 being mounted on the vehicle body 270 while the idler wheels 240 being mounted at the bottom of the washing water tank 60.

When the washing water tank 60 is made by the rotational molding technology, a socket can be provided at the bottom of the washing water tank 60, and a bearing can be placed therein to be pivotally connected with the rotation shaft on the vehicle frame. Moreover, in the rotational molding technology, a ring-shaped slot configured to place the ring-shaped rail 230 is pre-processed, a reinforcing slot radiating outward from the socket as the center is provided at the middle area between the socket and the ring-shaped slot, the ring-shaped rail 230 is placed in the ring-shaped slot, and a reinforcing rib is placed in the reinforcing slot, which reinforces the washing water tank 60 while guiding the washing water tank.

Specifically, the reinforcing rib can be made of metal.

The above is merely detailed description of one specific arrangement of the rotating assembly, which is not intended to limit the specific arrangement of the rotating assembly in the present embodiment. It is sufficient that the rotating assembly can achieve rotational support for the swinging of the washing water tank 60.

In addition, by arranging the rotating assembly, the rotating of the washing water tank 60 is supported at a certain degree, so that the load of the washing water tank 60 can be shared by the rotating assembly, moreover, the contact between the ring-shaped rail 230 and the idler wheels 240 has certain guiding effect on the washing water tank 60, so that the washing water tank 60 can rotate along the path of the ring-shaped rail 230. Furthermore, the arrangement manner of the idler wheels 240 also greatly reduces the friction force in the rotating process of the washing water tank 60, ensuring the reliability of the wagging of the washing water tank 60.

In the present embodiment, the idler wheels 240 can also be annularly and uniformly distributed around the rotation shaft through which the washing water tank 60 is pivotally connected with the vehicle frame.

Figure 6:
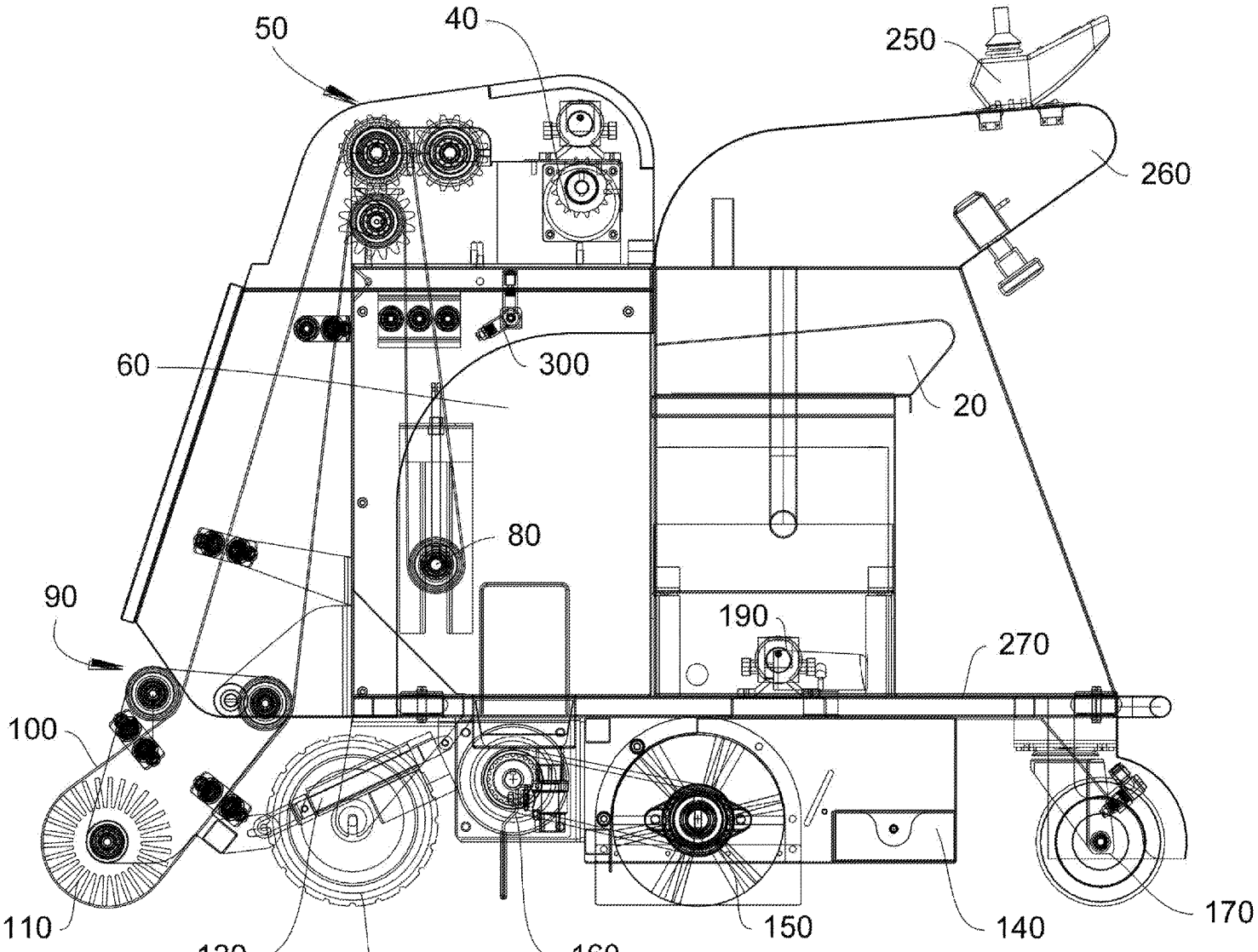
FIG. 6 is a schematic structural diagram of another large to medium-size sweeping and mopping vehicle according to embodiments of the present disclosure.

Still referring to FIG. 3 in combination with FIG. 6, in this embodiment, the clean water tank 10 can be arranged by the side of the seat 20, and the manipulation mechanism and the control module 260 can be arranged in front of the seat 20. Such arrangement greatly reduces the length of the vehicle body, and therefore enhances the structural compactness of the mopping vehicle. Moreover, the wheel(s) driving the vehicle body 270 to advance can be disposed at the front of the vehicle frame, and there can be one driving wheel, i.e., there are one front wheel 170 and two rear wheels 130. Such arrangement can substantially realize the in-situ rotation of the whole vehicle, thereby greatly improving the operation flexibility of the mopping vehicle. In the present embodiment, the travelling direction of the mopping vehicle is regarded as front (forward), the clean water tank 10 can be arranged on the left side or the right side of the seat 20, and in order to provide sufficient water source to the mopping vehicle for operation, the clean water tanks 10 can be arranged on the left side and the right side of the seat 20, respectively.

In this embodiment, the washing water tank 60 may comprise a washing area and a filtering area. The ring-shaped mop 100 can enter the washing area to be washed. A filter screen for separating the washing area from the filtering area is arranged between the washing area and the filtering area, and there is at least one layer of the filter screen. When there are multiple layers of the filter screens, the multiple layers of filter screens are arranged at intervals, and the diameters of filter holes of each filter screens are gradually reduced in the direction away from the ring-shaped mop 100.

By providing the multiple layers of filter screens inside the washing water tank 60, the washing water tank 60 is divided into a washing area and a filtering area, the ring-shaped mop 100 is washed using the water in the washing area, the used dirty water is filtered by the filter screen at the same time, and relatively clean water is obtained in the filtering area.

In the present embodiment, the filter screens can be obliquely arranged in the washing water tank 60, and a filtering nozzle 300 configured to flush the filter screen can be arranged above the filter screens. In the above, the filter screen can be lifted upwards relative to the washing water tank 60, and at the moment, the bottom of the filter screen is separated from the bottom wall of the washing water tank 60.

When the filter screen needs to be cleaned after having been used for a period of time, it is feasible to open the filtering nozzle 300 to flush the surface of the filter screen from the top to bottom. The oblique arrangement of the filter screen ensures, to a certain extent, that each part of the filter screen is able to be effectively flushed, thereby ensuring the flushing effect. Moreover, by lifting upwards the filter screen, the different areas separated by the filter screens of the washing water tank 60 communicates with each other at the bottom thereof and therefore all the solid dirt in the washing water tank 60 can be discharged, thereby achieving the purpose of cleaning the washing water tank 60.

In order to improve the cleaning efficiency, in the present embodiment, the bottom wall of the washing water tank 60 can also be arranged to be oblique. Such arrangement enables that when the individual filter screens are lifted up, the solid dirt can slide out of the bottom wall under the action of its own gravity.

It should be noted that in the present embodiment, the upper portions of the multiple layers of filter screens can be inclined towards the ring-shaped mop 100 by the same inclination angle. Moreover, peripheries of the multiple layers of filter screens can be fixed using a metal frame, two side walls of each filter screen are inserted into sealing slots inlayed with rubber or soft plastic strips, the lower ends of all the sealing slots are further connected with rubber blocks or soft plastic plates, sliding slots are arranged inside the side wall of the washing water tank 60, and fixing of the filter screen is realized by inserting the multiple layers of filter screens into the sliding slots.

It should also be noted that in the present embodiment, the multiple layers of filter screens can be either manually lifted upwards, or automatically lifted upwards by providing a power device.

In this embodiment, the division of the washing water tank 60 into the washing area and the filtering area can be achieved by the above described structural form of multiple layers of filter screens, but not limited thereto, and other structural forms can also be used. For example, a partition plate is arranged inside the washing water tank 60 to separate the washing area from the filtering area, and a filter is arranged on the partition plate, the dirty water in the washing area enters the filtering area after being filtered by the filter. In the present embodiment, the filter can be composed of a self-cleaning filter and a fine net which is arranged on the self-cleaning filter and can meet the filtering requirement.

By dividing the washing water tank 60 into a washing area and a filtering area and disposing a filtering structure therebetween to flush the ring-shaped mop 100 by using the water in the washing area and meet the ground cleaning requirements of the mopping vehicle by using the water in the filtering area, functional diversity of the washing water tank 60 is realized, and the purpose of recycling water is achieved to a certain extent, so that efficient allocation and reasonable utilization of the resources are achieved.

In one mode, a filter is suspended in the washing water tank 60, the lower portion of the filter is the filter screen, and a dirty water pump pumps the dirty water from the lower portion of the washing water tank 60 to the filter. The filter can be rectangular, or multi-stage filtration can be formed in the length direction, the filtered water can first enter the filtering area for being used by a flushing nozzle 210, and the surplus water can be discharged into the washing area.

Referring to FIG. 3, in the present embodiment, the mopping vehicle can further comprise at least one flushing nozzle 210 configured to flush the ground. Specifically, the flushing nozzle 210 is installed on the vehicle body 270, and the included angle between the spraying direction of the flushing nozzle 210 and the ground ranges from 20° to 70°. After being sprayed from the flushing nozzle 210, the water can splash onto the ring-shaped mop 100 under the reflection effect of the ground. Both the clean water tank 10 and the washing water tank 60 can supply water for the flushing nozzle 210.

Under the action of the water pump 190, clean water in the clean water tank 10 or in the filtering area of the washing water tank 60 is pumped to the flushing nozzle 210, so that the flushing nozzle 210 sprays water onto the recesses on the ground, and under the action of reflection angles, the dirty water after flushing is reflected onto the ring-shaped mop 100, and at the moment, this ring-shaped mop 100 has finished the mopping work, and is about to move upwards to be flushed in the washing area, and in the upward moving process of the ring-shaped mop 100, the dirty water is brought into the washing area, together with the ring-shaped mop, for being filtered.

By such arrangement, the dust in the recesses of the ground is brought into the washing area during the operation process of the mopping vehicle, which achieves the cleaning away of the dust in the recesses of the ground, and the dust in the recesses of the ground and the dust on the ring-shaped mop 100 are collected into the washing area for being processed together, which achieves efficient and reasonable utilization of the resources. In addition, such arrangement prevents, to a certain extent, dust from entering a sewer.

It should be noted that in the present embodiment, the flushing nozzle 210 can be a fan-shaped nozzle, namely, the water flow sprayed out from the flushing nozzle 210 is in a fan shape. Such arrangement greatly improves the spraying area of the flushing nozzle 210, not only ensuring the cleaning effect, but also saving water. Moreover, in the present embodiment, a row of flushing nozzles 210 can be arranged in the width direction of the ring-shaped mop 100.

In the present embodiment, a water intake is arranged in the filtering area of the washing water tank 60, and a fine net is arranged at the water intake. Specifically, the water intake is in communication with the flushing nozzle 210 through a pipeline, the pipeline between the water intake and the flushing nozzle 210 is provided with a water pump 190, a first control valve configured to control connection/disconnection of the pipeline is arranged between the water pump 190 and the water intake, a branch pipeline is arranged on a pipeline between the first control valve and the water pump 190, the branch pipeline is in communication with the clean water tank 10, and the branch pipeline is further provided with a second control valve configured to control connection/disconnection of the branch pipeline. That is, the water pump 190 is arranged on a main pipeline, while the first control valve is provided between the water pump 190 and the filtering area, and the second control valve is arranged on the branch pipeline between the water pump 190 and the clean water tank 10.

During the cleaning operation of the mopping vehicle, connection/disconnection of each pipeline can be realized by control over the first control valve and the second control valve, so that the requirement of water supply to the flushing nozzle 210 by the filtering area or the clean water tank 10 can be met. Specifically, when the first control valve is opened and the second control valve is closed, water is supplied to the flushing nozzle 210 by the filtering area; and when the first control valve is closed and the second control valve is opened, water is supplied to the flushing nozzle 210 by the clean water tank 10.

Preferably, during the cleaning operation of the mopping vehicle, it is feasible to open the first control valve and close the second control valve, and at the moment, the filtering area supplies clean water to the flushing nozzle 210. Such arrangement enables that water in the filtering area is used up first, and according to "cannikin law", at the moment, the dirty water in the washing area is continuously supplemented into the filtering area under the action of the filtering structure, so that the dirty water brought into the washing area as the ring-shaped mop 100 moves upwards is prevented from causing overflowing of water in the washing water tank 60 due to overfilling, which achieves relative balance between the washing area and the filtering area and further improves the working reliability of the mopping vehicle.

Of course, other branch pipelines can further be arranged on the main pipeline provided with the water pump 190, so as to provide a water source for all the pipelines in the mopping vehicle that require pressurized water.

It should be noted that in the present embodiment, the first control valve and the second control valve can be electromagnetic control valves and are in control connection with the control module 260. By operating the control module 260, the operator can realize the control over the working states of the first control valve and the second control valve, thereby realizing water source supplying by the washing water tank 60 or by the clean water tank 10.

Figure 5:
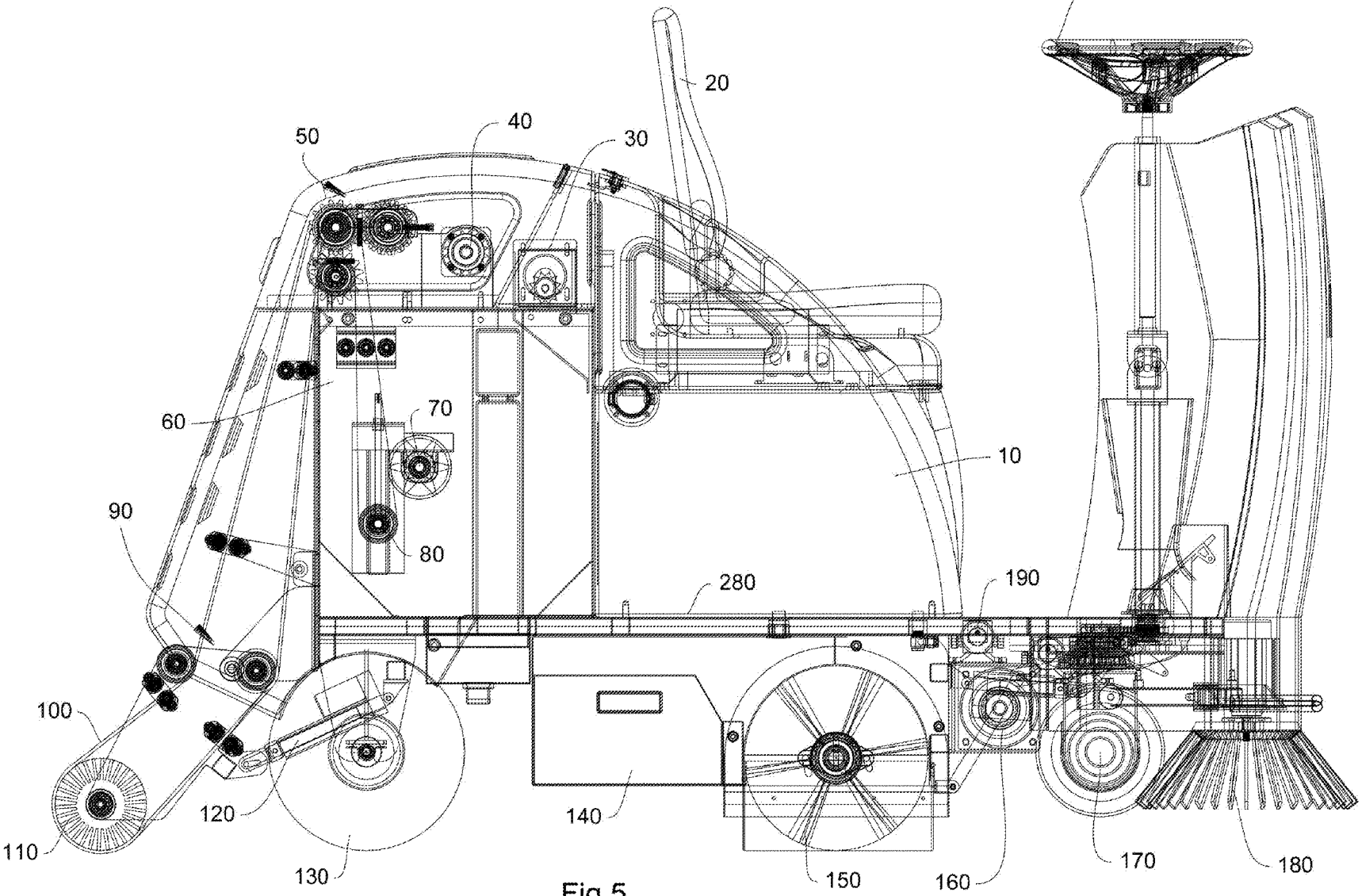
FIG. 5 is a schematic structural diagram of the large to medium-size sweeping and mopping vehicle in FIG. 3, from a second view angle.

Referring to FIG. 3 and FIG. 5, in this embodiment, the manipulation mechanism may comprise a steering wheel 200, wherein the steering wheel 200 arranged above the front wheel to directly control the direction of the front wheel.

The manipulation mechanism may employ the structural form of the steering wheel 200, but not limited thereto, and may also employ other structural forms, for example, a universal control lever 250 shown in FIG. 6, moreover, the universal control lever 250 can be mounted on one side of the vehicle body 270 and in front of the clean water tank 10. Such arrangement not only makes it easy for the driver to get on and off, but also provides great convenience for the single-hand operation of the driver.

In addition, in the present embodiment, the control module 260 can be powered by a battery, and other devices of the mopping vehicle that need electricity can also be powered by a battery. Moreover, a solar cell panel can further be arranged on the vehicle body 270, such that the solar cell panel absorbs heat and then generates electricity for the battery, which greatly saves energy and meets the requirement for building an environment-friendly society. In the above, the solar cell panel can be disposed above the seat 20, such that it not only can absorb the heat, but also can serve the function of blocking light rays for the driver. Furthermore, in the present embodiment, the angle of the solar panel can be adjusted so as to absorb the solar energy to the maximum extent.

The working process of the mopping vehicle in the present embodiment is described as follows:

During the cleaning operation, the driver controls the traveling and turning of the vehicle through the steering wheel 200, the disc-type sweeping edge brushes 180 is used to sweep the ground, and in the traveling process of the mopping vehicle, the main brush motor 160 works to drive the round-roller-type main sweeping brush 150 to collect the solid refuses and dust on the ground into the refuse collector 140. Moreover, under the action of the dragging motor 40, the ring-shaped mop 100 mops the ground under the guiding of the washing guiding roller 80, the dragging roller assembly 50 and the guiding roller assembly 90 and under the pressure of the guiding mopping roller 110, and moves upwards, after mopping has been completed, into the washing area to be washed. In the process of washing the ring-shaped mop 100, the washing motor 30 works to drive the washing roller 70 to wash the ring-shaped mop 100. Moreover, the flushing nozzle 210 flushes the recesses on the ground under the action of the high-pressure water flow from the water pump 190, and water is reflected by the ground and then is splashed onto the ring-shaped mop 100 (the ring-shaped mop 100 at the right side of the guiding mopping roller 110 in FIG. 3) which has just completed the mopping operation, so that the dirty water enters the washing area as the ring-shaped mop 100 ascends.

When it is necessary to clean narrow areas such as corners and roadsides and so on, it is feasible to control the mopping vehicle to walk to the vicinity of such areas, and control, using the swing motor 220, the washing water tank 60 to perform wagging operation so as to make it clean the operation areas. During the non-mopping time, the mopping mechanism can be lifted by using a third electric push rod 120.

Finally, it should be noted that the above embodiments are only used to illustrate the technical solutions of the present disclosure, rather than limiting the same; although the present disclosure has been described in detail with reference to the foregoing embodiments, it should be understood by a person of ordinary skills in the art that the technical solutions described in the embodiments can still be modified, or equivalent substitution can be made to some or all of the technical features therein; and the modification or substitution would not cause the essence of the corresponding technical solutions to get out of the scope of the technical solutions of the embodiments of the present disclosure.

INDUSTRIAL APPLICABILITY

To sum up, the present disclosure provides a large to medium-size sweeping and mopping vehicle, which has a compact structure, has a low manufacturing cost and can efficiently remove dust and refuses from the ground.

The invention claimed is:

1. A sweeping and mopping vehicle, comprising a vehicle body, and a disc-type sweeping mechanism, a round-roller-type sweeping mechanism and a first mopping mechanism that are sequentially provided along the vehicle body, wherein the disc-type sweeping mechanism comprises a clean water tank, and disc-type sweeping edge brushes driven by a motor and provided obliquely with respect to ground, the clean water tank being provided in front of a driver zone of the vehicle body, and each disc-type sweeping edge brush is provided with a nozzle, with the nozzle located above the disc-type sweeping edge brush and in communication with the clean water tank;

the round-roller-type sweeping mechanism comprises a refuse collector and a round-roller-type main sweeping brush driven by the motor to rotate horizontally; and the first mopping mechanism comprises a dragging roller, a guiding mopping roller, a guiding roller, a ring-shaped mop and a washing water tank, the washing water tank is provided behind the driver zone of the vehicle body, mop arms are hinged to the vehicle body, two ends of the guiding mopping roller and two ends of the guiding roller are fixedly connected with the mop arms, each mop arm is connected with the vehicle body through a lifting or upwardly-rotating mechanism, the ring-shaped mop is driven by the dragging roller and the guiding mopping roller to rotate, and the guiding roller is pressed on the ring-shaped mop.

2. The sweeping and mopping vehicle according to claim 1, wherein the first mopping mechanism further comprises a washing roller that is located in the washing water tank and configured to wash the ring-shaped mop.

3. The sweeping and mopping vehicle according to claim 1, wherein the disc-type sweeping edge brushes are provided in front of the driver zone of the vehicle body, and the round-roller-type sweeping mechanism is provided below the vehicle body.

4. The sweeping and mopping vehicle according to claim 1, wherein sweeping and mopping vehicle further comprises a second mopping mechanism is in a structure same as the first mopping mechanism, the second mopping mechanism is provided in front of the driver zone of the vehicle body, and the disc-type sweeping edge brushes and the round-roller-type sweeping mechanism are sequentially provided below the vehicle body.

5. The sweeping and mopping vehicle according to claim 1, wherein each disc-type sweeping edge brush is suspended on the vehicle body through a quadrilateral coupler, and a first electric push rod configured to control a height of the disc-type sweeping edge brush is mounted on the quadrilateral coupler.

6. The sweeping and mopping vehicle according to claim 1, wherein an upper portion of the refuse collector is connected with the vehicle body through four pull rods, and wheels are arranged below the refuse collector.

7. The sweeping and mopping vehicle according to claim 1, wherein the ring-shaped mop is made of long stapled chenille or coral flannelette, two sides of the ring-shaped mop are each provided with a grey fabric edge, and a circular cowhells plastic strip is wrapped in the grey fabric edge.

8. The sweeping and mopping vehicle according to claim 7, wherein a plurality of sets of fixed-width wheels are fixed at both an inner side and an outer side of the washing water tank, and the fixed-width wheels are configured to get the circular cowhells plastic strip stuck.

9. The sweeping and mopping vehicle according to claim 1, wherein the guiding mopping roller has a silica gel layer or a round roller hairbrush as an outer layer thereof, and the guiding mopping roller has a metal tube or a metal rod as an inner layer thereof.

10. The sweeping and mopping vehicle according to claim 1, wherein a solar-photovoltaic-cell power generation plate and a metal profile are arranged at a top of the vehicle body, the solar-photovoltaic-cell power generation plate is fixedly connected with the metal profile, one end of the metal profile is hinged to the top of the vehicle body, and the other end of the metal profile is connected with the top of the vehicle body through a second electric push rod.

11. The sweeping and mopping vehicle according to claim 1, wherein the sweeping and mopping vehicle further comprises a washing driving device, the mop arms are hinged to the washing water tank, the washing water tank is pivotally connected with the vehicle body, the washing driving device is configured to control the washing water tank to move so that the washing water tank can swing relative to the vehicle body with a vertical axis as a center, wherein when the washing water tank swings, the mop arms are driven to swing.

12. The sweeping and mopping vehicle according to claim 11, wherein the sweeping and mopping vehicle further comprises at least one flushing nozzle configured to flush the ground, the at least one flushing nozzle is connected with the vehicle body, and an included angle between a spraying direction of the at least one flushing nozzle and the ground is 20°-70°; the clean water tank and the washing water tank communicate with the at least one flushing nozzle; and when the at least one flushing nozzle sprays water, the water can be reflected by the ground to splash onto the ring-shaped mop.

13. The sweeping and mopping vehicle according to claim 12, wherein the washing water tank is provided therein with a filtering area and a washing area that is configured to allow the ring-shaped mop to enter and to be washed; multiple layers of filter screens configured to separate the washing area from the filtering area are arranged between the washing area and the filtering area, the multiple layers of filter screens are arranged at intervals, and diameters of filter holes of the filter screens are gradually reduced in the direction away from the ring-shaped mop; and the filtering area is configured to supply water to the at least one flushing nozzle.

14. The sweeping and mopping vehicle according to claim 13, wherein the filter screens are obliquely arranged in the washing water tank, and a filtering nozzle configured to flush the filter screens is provided above the filter screens; and the filter screens are capable of being lifted upwards relative to the washing water tank, so as to separate bottoms of the filter screens from a bottom wall of the washing water tank.

15. The sweeping and mopping vehicle according to claim 13, wherein a water intake is arranged in the filtering area, and a fine net is arranged at the water intake, the water intake is in communication with each flushing nozzle through a pipeline, the pipeline between the water intake and the flushing nozzle is provided with a water pump, a first control valve configured to control connection/disconnection of the pipeline is arranged between the water pump and the water intake, a branch pipeline is arranged on the pipeline between the first control valve and the water pump, the branch pipeline is in communication with the clean water tank, and the branch pipeline is provided with a second control valve configured to control connection/disconnection of the branch pipeline.

16. The sweeping and mopping vehicle according to claim 12, wherein the washing water tank is provided therein with a filtering area and a washing area that is configured to allow the ring-shaped mop to enter and to be washed; a partition plate configured to separate the washing area from the filtering area is arranged between the washing area and the filtering area, a filter is arranged on the partition plate, and the filter is configured to filter water in the washing area and enable the filtered water to enter the filtering area; and the filtering area is configured to supply water to the at least one flushing nozzle.

17. The sweeping and mopping vehicle according to claim 11, wherein the washing driving device comprises a swing motor and a swing member, the swing member is in a strip shape and is bendable and deformable, two free ends of the swing member are connected to different parts of the washing water tank respectively, and a power output end of the swing motor is configured to expand and stretch the swing member and drive the swing member to reciprocate, so as to drive the washing water tank to swing.

18. The sweeping and mopping vehicle according to claim 17, wherein the sweeping and mopping vehicle further comprises an adjusting assembly configured to adjust a position of the washing water tank; and the adjusting assembly comprises an elastic member through which the free ends of the swing member are connected with the washing water tank.

19. The sweeping and mopping vehicle according to claim 11, wherein the sweeping and mopping vehicle further comprises a rotating assembly configured to rotationally support swinging of the washing water tank; the rotating assembly comprises a ring-shaped rail and a plurality of idler wheels capable of freely moving in the ring-shaped rail; and the ring-shaped rail is mounted at a bottom of the washing water tank, and the idler wheels are mounted on the vehicle body; alternatively, the ring-shaped rail is mounted on the vehicle body, and the idler wheels are mounted at a bottom of the washing water tank.

20. A mopping vehicle, comprising a vehicle body, a seat, a manipulation mechanism, a control module, a clean water tank, a washing water channel, an operation mechanism, a sweeping mechanism and a mopping mechanism, the washing water channel being provided behind the vehicle body, wherein the washing water channel is pivotally connected with the vehicle body, and the mopping vehicle further comprises a washing driving device that is configured to control the washing water channel to move, the washing water channel is capable of swinging relative to the vehicle body with a vertical axis as a center, the mopping mechanism is mounted on the washing water channel, and when the washing water channel swings, the mopping mechanism is driven to swing.

* * * * *